US006031365A

United States Patent [19]

Sharpe-Geisler

[11] Patent Number: 6,031,365

[45] Date of Patent: Feb. 29, 2000

[54] BAND GAP REFERENCE USING A LOW VOLTAGE POWER SUPPLY

[75] Inventor: Bradley A. Sharpe-Geisler, San Jose, Calif.

[73] Assignee: Vantis Corporation, Sunnyvale, Calif.

[21] Appl. No.: 09/276,991

[22] Filed: Mar. 26, 1999

Related U.S. Application Data

[60] Provisional application No. 60/079,788, Mar. 27, 1998.

[51] Int. Cl.[7] ..... G05F 3/16

[52] U.S. Cl. ..... 323/313; 323/316

[58] Field of Search ..... 323/312, 313, 323/314, 315, 316; 327/538, 539, 63, 65, 66

[56] References Cited

U.S. PATENT DOCUMENTS

| | | | |
|---|---|---|---|
| 4,897,595 | 1/1990 | Holle | 323/314 |
| 5,229,710 | 7/1993 | Kraus et al. | 323/313 |
| 5,229,711 | 7/1993 | Inoue | 323/313 |
| 5,313,114 | 5/1994 | Poletto et al. | 327/65 |
| 5,352,972 | 10/1994 | Pernici et al. | 323/313 |
| 5,568,045 | 10/1996 | Koazechi | 323/314 |
| 5,789,906 | 8/1998 | Mizuide | 323/313 |
| 5,867,012 | 2/1999 | Tuthill | 323/313 |
| 5,936,392 | 8/1999 | Taylor | 323/315 |

*Primary Examiner*—Adolf Deneke Berhane
*Attorney, Agent, or Firm*—Fliesler, Dubb, Meyer & Lovejoy

[57] ABSTRACT

A band gap reference includes an operational amplifier with an output (n23) driving the gate of three current source transistors (501–503). The first current source (501) drives the (+) opamp input (n20) and a transistor (511) functioning as a diode. The second current source (502) drives the (–) opamp input and a series resistor ($R_1$) and a transistor (512) functioning as a diode. The third current source (503) drives a series resistor ($R_2$) and diode connected transistor (513). The opamp includes first series transistors (521) and (524) connected between $V_{DD}$ and $V_{SS}$, and second series transistors (522) and (525) connected between $V_{DD}$ and $V_{SS}$. With only two series transistors between $V_{DD}$ and $V_{SS}$ at any point, only two times a CMOS transistor threshold drop (less than 1.8 volts) will occur enabling $V_{DD}$ to range from 1.8–3.6 volts without altering the band gap reference output voltage ($V_{DIODE}$). Further, CMOS transistors in the circuit may operate with a 2.7 volt maximum gate to source, or gate to drain voltage.

17 Claims, 4 Drawing Sheets

BAND GAP REFERENCE USING A LOW VOLTAGE POWER SUPPLY

CROSS-REFERENCE TO RELATED APPLICATION

This application claims the benefit of U.S. Provisional Application No. 60/079,788, filed Mar. 27, 1998.

BACKGROUND OF THE INVENTION

1. Field of the Invention

The present invention relates to a band gap reference. More particularly, the present invention relates to a band gap reference which can operate with 2.5 volt transistors and provide a constant reference voltage during power supply voltage variations and temperature changes.

1. Description of the Related Art

I. Prior Art Circuit of FIG. 1

FIG. 1 shows components used to form a prior art band gap reference. The band gap reference includes three variable current sources $I_1$, $I_2$ and $I_3$ composed of PMOS transistors. The gates of the transistors forming the current sources $I_1$–$I_3$ are connected together. With the same voltage at the gate of all three current sources $I_1$, $I_2$ and $I_3$, the total current supplied by each current source will be substantially equal.

The band gap reference circuit of FIG. 1 also includes three diodes $D_1$, $D_2$ and $D_3$, each composed of a PNP bipolar transistor with a base and collector connected to $V_{SS}$ or ground. Diode $D_2$ is indicated as 10 times larger than diode $D_1$. $D_2$ may be composed of 10 parallel connected transistors each having the same size as the single transistor forming $D_1$. As such, the current through each of the 10 diodes $D_2$ will be 1/10 the current through $D_1$, since $I_1$ and $I_2$ will be equal. The difference in voltage across diodes $D_1$ and $D_2$ will have a relation dependent on temperature as can be seen from the current to voltage relation for a silicon diode which is as follows:

$$I=Io(\epsilon^{V/2VT}-1)$$

VT is kT/q where T is temperature in Kelvin, k is Boltzmann's constant, and q is the charge on an electron. Io is the reverse saturation current for the diode.

The circuit of FIG. 1 functions to maintain an equal voltage at nodes n1 and n2. Initially, with $D_2$ larger than $D_1$ and equal current from $I_1$ and $I_2$, the node n1 will try to go lower than the node n2, and current through $I_1$, $I_2$ and $I_3$ will increase. Current will increase until the voltage across resistor $R_1$ balances the voltage difference between $D_1$ and $D_2$ as controlled by NMOS transistors $T_1$ and $T_2$. With node n2 voltage later increasing above n2, current in $I_1$, $I_2$ and $I_3$ will decrease until the voltage across $R_2$ balances the voltage difference between $D_1$ and $D_2$. A more detailed description of the operation of the circuit of FIG. 1 is described in the following paragraphs.

In operation, we initially assume that node n1 is below the voltage of node n2 since $D_2$ is larger than $D_1$. The current sources $I_1$ and $I_2$ will carry the same current, since their gates are connected together and the current source transistors will be in saturation mode. Transistors $T_1$ and $T_2$ which are the same size and connected in a source follower configuration will also carry the same current. With node n2 above n1, transistor $T_2$, connected in a cascode configuration, will try to sink more current to pull down node n3. The node n3 voltage will be reduced until the voltage on n1 and n2 are equal.

Note that a cascode transistor is a transistor defined by being turned on and off by varying voltage applied to the source with the gate voltage substantially fixed when the transistor is an NMOS device. With the source voltage decreasing relative to the gate, the cascode transistor will turn on to a greater extent. With the source voltage increasing relative to the gate, the cascode transistor will turn off to a greater extent.

If n1 goes above n2, $T_2$ will sink less current than $T_1$. Node n3 will then be pulled up, reducing current supplied from $I_2$. Node n3 voltage will increase until the voltage on n1 and n2 are substantiallyequal.

In summary, the relationship of node n1 to node n2 determines increasing or decreasing current through current sources $I_1$, $I_2$ and $I_3$.

After the balance point is reached, the current from current sources $I_1$, $I_2$, or $I_3$ will vary in proportion to temperature due to the variation of the difference in voltage across diodes $D_1$ and $D_2$ with temperature, as can be seen from the silicon diode equation above. The voltage difference will decrease with increasing temperature, so that with higher temperatures greater current will be provided from $I_1$, $I_2$ and $I_3$. Current from $I_1$, $I_2$ and $I_3$ will, thus, vary in proportion to temperature. The resistance $R_1$ is set to control the average current supplied from the current sources $I_1$, $I_2$ and $I_3$.

A resistor $R_3$ and diode $D_3$ connect the output $V_{DIODE}$ to ground. With the current of $I_3$ increasing in proportion to temperature, the voltage across $R_2$ will likewise increase with temperature. The voltage across the diode $D_3$, however, will decrease with temperature variations. The $D_3$ voltage will otherwise remain constant with temperature. The resistance of resistor $R_2$ is chosen so that the voltage change with temperature across $R_2$ will balance the voltage change with temperature across diode $D_3$ so $V_{DIODE}$ will remain constant.

The circuit of FIG. 1 is referred to as a band gap reference because the voltage $V_{DIODE}$ will be substantially equal to the voltage across the p-n band gap of a diode. For silicon, $V_{DIODE}$ will be approximately 1.2 volts.

III. Prior Art Circuit of FIG. 2

FIG. 2 shows the band gap reference of FIG. 1 modified to include an inverter INV and transistor $T_3$ to get the circuit out of a potential forbidden state at start up. After start up, node n3 may be high while transistors $T_1$ and $T_2$ remain off. The inverter INV will then pull down the gate of $T_3$. Transistor $T_3$ then applies additional current to the drain which raises n4 and so turns on transistors $T_1$ and $T_2$. Transistor $T_2$ will then pull down n3 and turn on current sources $I_1$ and $I_3$. The inverter INV will then turn off.

IV. Prior Art Circuit of FIG. 3

FIG. 3 shows modifications to the band gap reference circuit of FIG. 2 to include transistors $T_4$, $T_5$ and $T_6$ to limit variations in $V_{DIODE}$ with changes in $V_{DD}$. In the circuit of FIGS. 1 and 2, since the gate and drain of the transistor forming current source $I_2$ are connected, node n3 will be 1 vt below $V_{DD}$ (vt being a CMOS transistor threshold). Node n4 will be 1 vt above n2 since the drain and gate of transistor $T_2$ are connected, and node n2 will be 1 vt above ground as set by the PNP transistor forming diode $D_1$. However, with $V_{DD}$ changing n3 will change since it is 1 vt below $V_{DD}$, but n4 being 2 vt above ground will not. Thus, current will vary in current source $I_1$ relative to current source $I_2$ because although $I_1$ and $I_2$ have the same respective gate and source voltages, their drain voltages will vary relative to each other depending on $V_{DD}$ variations. Accordingly, the current sources $I_1$, $I_2$ and $I_3$ will not be equal and $V_{DIODE}$ will vary with $V_{DD}$ changes.

In the circuit of FIG. 3, node n3 will be 1 vt below $V_{DD}$ with the source and drain of transistor forming $I_2$ tied together. Since the drain of transistor $T_4$ is not tied to its gate, node n10 will not be at a fixed number of vt drops relative to ground. Since transistors $T_4$ and $T_5$ are connected in a source follower configuration, node n10 will be equal in voltage to node n3. In other words, the respective gate, source, and drain voltage of transistors forming $I_1$ and $I_2$ will be equal, so $I_1$ and $I_2$ are biased the same. Therefore the current from current sources $I_1$, $I_2$ and $I_3$ will be equal.

However with low voltage circuits, such as a device using transistors made using a 2.5 volt semiconductor process technology, the maximum value for $V_{DD}$ may be lower than a value necessary for the circuit of FIG. 3 to function. For a 2.5 volt device, $V_{DD}$ will typically be 2.5 volts. In the circuit of FIG. 3, a 1 vt drop will be applied across the transistor for $I_2$, the transistors $T_5$ and $T_1$ and the transistors for each of diodes $D_1$, $D_2$ and $D_3$. Assuming a minimum vt is approximately 0.7 volts, the total voltage for four stacked transistors will be 2.8 volts. If temperature drops, however, the voltage vt can rise significantly. The typical room temperature vt for PMOS transistors may exceed 1.0 volts. Thus, the total voltage across four stacked transistors can easily exceed 3.0 volts.

The circuit of FIG. 2 has three stacked transistors, so it can use a $V_{DD}$ supply of 3.0 volts, but as indicated above, its current sources $I_1$, $I_2$ and $I_3$ may vary relative to one another with $V_{DD}$ variations.

SUMMARY OF THE INVENTION

In accordance with the present invention, a band gap reference is provided which can operate with 2.5 volt transistors supplied from a 1.8–3.6 volt pin supply $V_{DD}$. The band gap reference circuit can further provide current sources which are stable with variations in $V_{DD}$.

In accordance with the present invention, a band-gap reference circuit is provided including an operational amplifier with an output driving the gate of three current source transistors. The first current source drives the (+) opamp input and a first diode connected transistor. The second current source drives the (−) opamp input and a series resistor and a second diode connected transistor. The third current source drives a series resistor and third diode connected transistor. With the opamp output controlling the gate of all three current source transistors, the current sources will not vary significantly with respect to one another with changes in $V_{DD}$.

The opamp circuitry in one embodiment includes two sets of two series transistors connected between $V_{DD}$ and $V_{SS}$. Each set includes one transistor with a gate forming an input of the opamp, and one transistor connected in a current mirror configuration serving as a current source. The output of one of the current sources in a set provides an opamp output.

The opamp circuitry in another embodiment includes a third set of two series transistors connected between $V_{DD}$ and $V_{SS}$ to provide buffering of the opamp output and greater gain. The third set includes one transistor with a gate connected to one input of the opamp, and one transistor forming a current source having a gate driven by the output of the first stage of the opamp.

With the circuitry described, the band gap reference in accordance with the present invention includes only two series transistors between $V_{DD}$ and $V_{SS}$ at any point. With only two series transistors, only two times a CMOS transistor threshold drop (less than 1.8 volts) will occur between $V_{DD}$ and $V_{SS}$ enabling $V_{DD}$ to range from 1.8–3.6 volts without altering the band gap reference output voltage with changes in $V_{DD}$. Further, CMOS transistors in the circuit may be 2.5 volt devices, meaning that a single transistor can sustain a 2.7 volt maximum gate to source, or gate to drain voltage. A 2.5 volt device typically has a gate length of 0.25 microns or less and a gate oxide thickness of 60 Angstroms or less.

Further in accordance with the present invention, the present invention might include circuitry to bias the base of transistors forming the first and second diodes to limit fluctuations in the first, second and third current sources with loading. The biasing circuitry can further assure transistors of the opamp turn on properly at start up. The bias circuitry includes a biasing transistor and current sink resistor connected in series between the bases of the transistors forming the first and second diodes and $V_{SS}$. The transistors of the opamp are coupled to $V_{SS}$ through only the current sink resistor. The gate of the biasing transistor is connected to an input of the opamp.

Further in accordance with the present invention, the band gap reference circuit may include circuitry to prevent a potential forbidden state at startup. The circuitry to prevent the potential forbidden state includes an inverter connecting the output of the opamp to the gate of a current source transistor supplying current to an input of the opamp. The inverter includes a PMOS pull up transistor and an NMOS pull down transistor, along with an additional NMOS transistor connected between the drain of the NMOS pull down transistor and the inverter output to limit power voltage stress of the NMOS pull down transistor.

BRIEF DESCRIPTION OF THE DRAWINGS

Further details of the present invention are explained with the help of the attached drawings in which.

DETAILED DESCRIPTION

Figure 3:
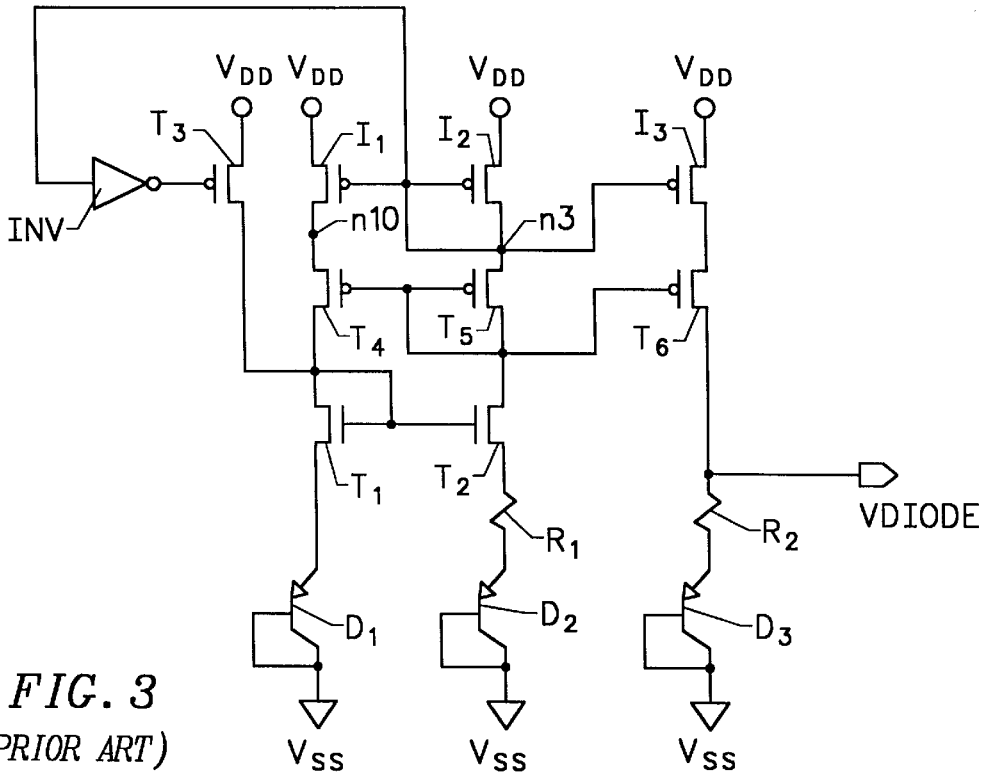
FIG. 3 (PRIOR ART)
FIG. 3 shows the circuit of FIG. 2 modified to include circuitry to limit output voltage variations with changes in a pin supply voltage $V_{DD}$.
Figure 4:
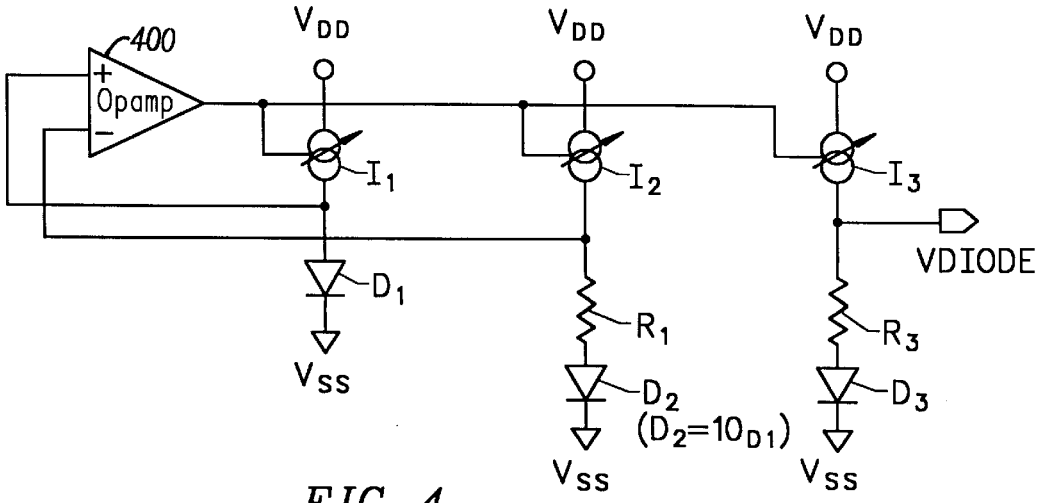
FIG. 4 shows a band gap reference circuit of the present invention.

FIG. 4 shows components used in a band gap reference in accordance with the present invention. The band gap reference of FIG. 4 utilizes an operational amplifier (opamp) 400 in place of the transistors $T_1$ and $T_2$ of FIGS. 1 and 2, or transistors $T_1$, $T_2$, $T_4$, $T_5$, and $T_6$ of FIG. 3. The opamp can include 2.5 volt transistors, as shown in detail in FIG. 5, enabling the circuit of FIG. 4 to be used with 2.5 volt transistors with $V_{DD}$ ranging from 1.8–3.6 volts, and maintaining an equal current from current sources $I_1$, $I_2$ and $I_3$.

The band gap reference includes three variable current sources $I_1$, $I_2$ and $I_3$ with current flow controlled by the output of an opamp 400. The current sources $I_1$, $I_2$ and $I_3$ are preferably single PMOS transistors with the output of opamp 400 driving their gate. With the same voltage controlling all three current sources $I_1$, $I_2$ and $I_3$, the total current supplied by each current source will be substantially equal.

Figure 1:
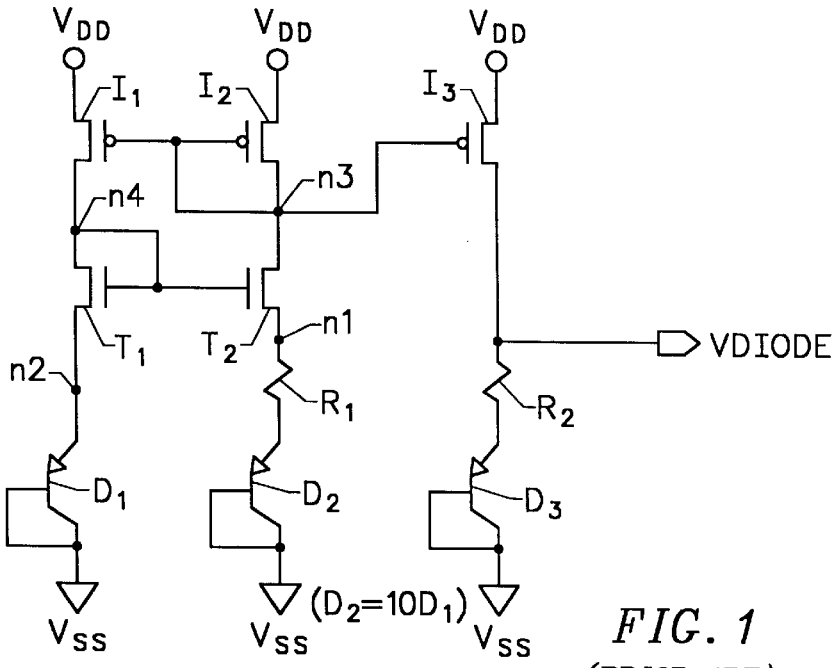
FIG. 1 (PRIOR ART)
FIG. 1 shows components used to form a prior art band gap reference.
Figure 2:
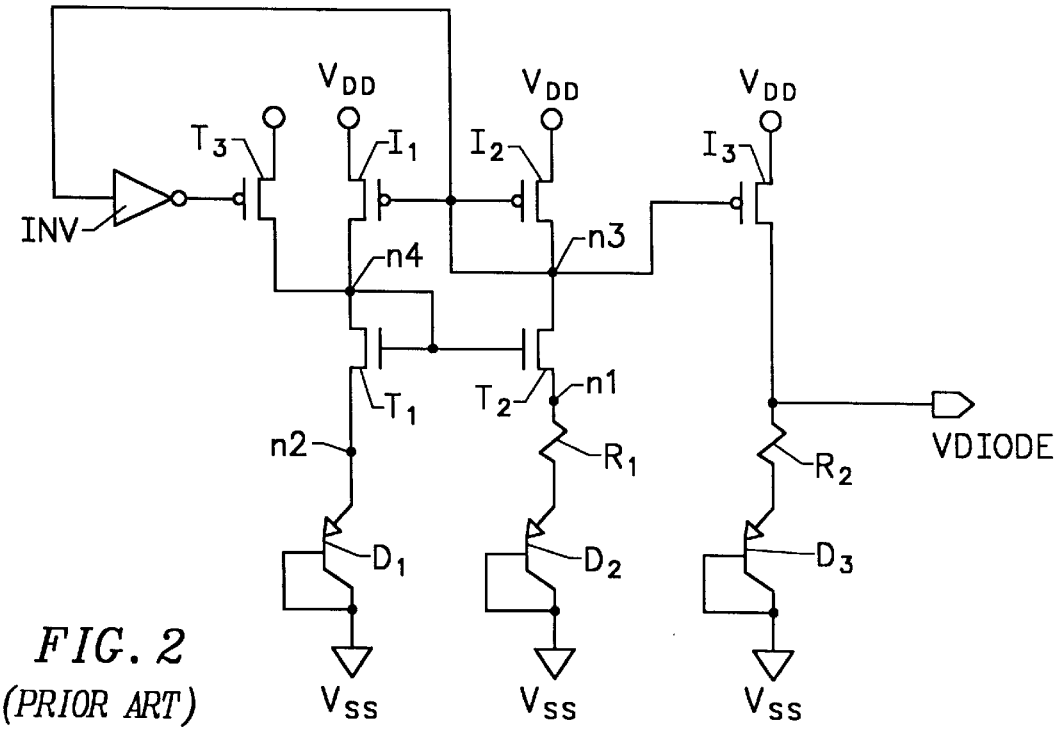
FIG. 2 (PRIOR ART)
FIG. 2 shows the circuit of FIG. 1 modified to include circuitry to get out of a forbidden start up state.

The circuit of FIG. 4 further includes diodes $D_1$–$D_3$, similar to FIGS. 1–3. The diodes $D_1$–$D_3$ may be either standard diodes, or the diode connected transistors shown in FIGS. 1–3. Diode $D_2$ is shown to be 10 times larger than diode $D_1$, although other sizes might be used in accordance with the present invention. Diode $D_2$ may either have a larger channel than $D_1$, or be composed of a number of parallel connected diodes. The difference in voltage across diodes $D_1$ and $D_2$ will have a relation dependent on temperature as indicated previously.

Initially, with diode $D_2$ larger than $D_1$ and equal current from $I_1$ and $I_2$, the − terminal of the opamp 400 will be driven lower than the + terminal, and the output voltage from opamp 400 will increase to increase current through $I_1$, $I_2$ and $I_3$. Current will increase until the voltage across resistor $R_1$ balances the voltage difference between $D_1$ and $D_2$. After the balance point is reached, the current from $I_1$, $I_2$, and $I_3$ will vary in proportion to temperature due to the variation of the difference in voltage across diodes $D_1$ and $D_2$ with temperature, as can be seen from the silicon diode equation identified previously. The voltage difference will decrease with increasing temperature, so that with higher temperatures greater current will be provided from $I_1$, $I_2$ and $I_3$. The resistance $R_1$ is set to control the average current supplied from the current sources $I_1$, $I_2$ and $I_3$.

A resistor $R_3$ and diode $D_3$ connect the output $V_{DIODE}$ to ground. With the current of $I_3$ increasing in proportion to temperature, the voltage across $R_3$ Will likewise increase with temperature. The voltage across the diode $D_3$, however, will decrease with temperature variations. The diode $D_3$ voltage will otherwise remain constant with temperature. The resistance of resistor $R_3$ is chosen so that the voltage change with temperature across $R_3$ Will balance the voltage change with temperature across diode $D_3$ so $V_{DIODE}$ will remain constant.

Figure 5:
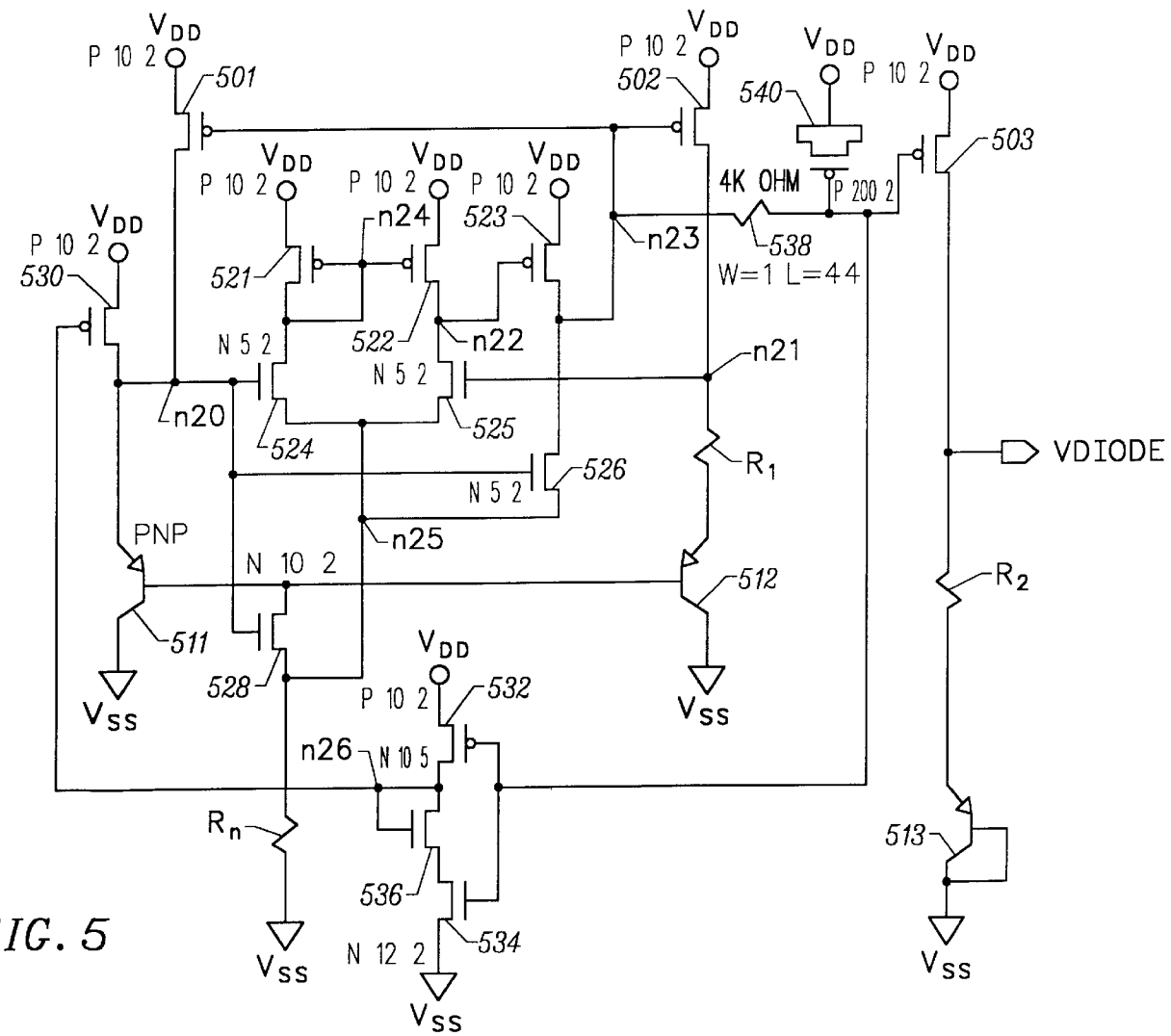
FIG. 5 shows detailed circuitry for a band gap reference of the present invention.

FIG. 5 shows detailed circuitry for a band gap reference of the present invention. The circuit includes current source transistors 501, 502 and 503. The current source 503 drives a series resistor $R_2$ and diode connected PNP transistor 513, the transistor 506 having a base and collector connected to ground. The current source 502 drives a series resistor $R_1$ and PNP transistor 512. The current source 501 drives a PNP transistor 511. Note in relation of the circuit of FIGS. 1 and 3, the circuit of FIG. 5 includes only two stacked transistors between a power supply $V_{DD}$ and $V_{SS}$. With two stacked transistors, $V_{DD}$ may range from 1.8 to 3.6 volts, and the 2 vt drop from $V_{DD}$ to $V_{SS}$ through the current sources will not deplete the power supply. The value $V_{SS}$ referred to herein is preferably at ground.

The circuit of FIG. 5 further includes a circuit functioning like the opamp 400 of FIG. 4, including transistors 521–526. The opamp transistors 521–526 function to drive nodes n20 and n21 (the − and + inputs of the opamp) to equal values.

In operation it is first assumed that node n20 is above node n21. Transistors 521 and 522 are connected in a current mirror configuration to sink the same current to drive the drains of transistors 524 and 525. With node n20 above n21, transistor 524 will turn on to a greater degree than 525 and node n22 will charge up. With n22 charging up, transistor 523 turns off more. Transistor 526 has a gate connected to the gate of transistor 524 and a source connected to the source of transistor 524 to sink the same current as transistor 524. With transistor 523 turning off more the voltage on node n23 will drop. With the voltage on node n23 dropping, current sources 501 and 502 will turn on more strongly. Current will increase from current sources 501 and 502 until the voltage drop across resistor $R_1$ equals a voltage difference across PNP transistors 511 and 512.

With variations in $V_{DD}$, transistors 521 and 522 will not vary with respect to one another as described below. With the gate and drain of transistor 521 connected together at node n24, node n24 will be at 1 vt below $V_{DD}$. The transistors 524 and 525 do not have their source and drain connected together. Further, the sources of transistors 524 and 525 are connected to a common node n25, so the source of transistors 524 and 525 will be at the same voltage. The voltage at the gates of transistors 524 and 525 will be pulled to the same value. An identical source and gate voltage is applied to transistors 521 and 522, so, the drain voltages of transistors 521 and 522 will be equal and transistors 521 and 522 will source the same current irrespective of $V_{DD}$ changes.

Without cascode connected transistors, such as transistors $T_1$ and $T_2$ in FIG. 1, the current sources 501, 502 and 503 in FIG. 5 may see different loads, and then have a mismatched current. For example, the voltage $V_{DIODE}$ driven by transistor 503 is connected to ground through a resistor $R_2$ and diode connected transistor 513. Current source 503 should be sourcing the same current as current source 501, but node n20 is separated from ground by only a PNP transistor 511 which is preferably the same size as PNP transistor 513. With the PNP transistor 511 having its base and emitter connected to ground, and the additional resistance $R_2$ provided between $V_{DIODE}$ and transistor 513, $V_{DIODE}$ and node n20 will be at different voltages. With the gates of transistors 501–503 connected together and their sources all receiving $V_{DD}$, current sources 501–503 will then not source the same current.

To assure current sources 501–503 provide the same current irrespective of loading, instead of connecting the base of PNP transistors 511 and 512 directly to ground, transistors 511 and 512 have bases connected through a transistor 528 and resistor Rn to ground.

A problem can occur because a vt drop greater than the voltage across transistor 511 is required to turn on transistor 524. Transistor 524 may then not turn on at all at start up and the band gap circuit will not function to control the voltage $V_{DIODE}$. However, if the base of transistors 511 and 512 are connected through transistor 528 which has a gate connected at node n20 to the gate of transistor 524, then unless node n20 is at a high enough voltage to turn on transistor 524, no current will flow to the base of PNP transistor 511 and PNP transistor 511 will remain off. For the PNP transistor 511 to turn on, transistor 528 must be on. All base current for the PNP transistor 511 must go through transistor 528. If transistor 528 is on, transistor 524 will then turn on at the same time with an equal gate voltage. Thus, the PNP transistor 511 will not turn on independent of transistor 524. In the circuit of FIG. 1, with current source transistors $I_1$ and $I_2$ stacked with transistors $T_1$ and $T_2$, unlike transistors 511 and 524, a turn on voltage difference would not occur.

The resistor Rn has a value set to control the current through transistors 524 and 525 as sourced from transistors 521 and 522. Instead of resistor Rn, a current sink may be provided by a transistor with a gate connected to a voltage reference. However, the resistor Rn and diode process effects can cancel, so a resistor Rn providing a current sink may be more desirable for $V_{DIODE}$ to properly track temperature. The sizes for transistor 528 and resistor Rn can be adjusted to assure that at an expected normal operating temperature, node n20 and $V_{DIODE}$ will have exactly the same voltage so that current sources 501, 502 and 503 will sink the same current.

Transistors 530, 532, 534 and 536 serve as a circuit to prevent a forbidden state from occurring, similar to the inverter INV and transistor $T_3$ in FIGS. 2 and 3. In the circuit of FIG. 5, node n23 can go high while transistors 524 and 525 remain off. With the transistors 530, 532, 534 and 536 included to prevent such a state, when node n23 goes high, transistor 534 will turn on to pull down node n26 and turn on transistor 530. Transistor 530 will turn on to pull up node n20 and turn on transistors 524 and 526. With transistor 524 on, node n24 will be pulled down to turn on transistor 522. Transistor 522 will then pull up node n22 to turn off transistor 523. With transistor 526 on, node n23 will be pulled down to get the circuit of FIG. 5 out of the forbidden state. With node n23 pulled down, transistor 532 will turn on to pull up n26 to turn off transistor 530 so that the forbidden state circuitry is ineffective.

An RC filter made up of resistor 538 and a capacitor connected transistor 540 is included in the circuit of FIG. 5 to damp out potential oscillations caused by feedback from loading on the $V_{DIODE}$ connection.

For CMOS transistors shown in FIG. 5, the transistor type (p or n) is shown next to width in microns and length in microns. For the circuit of FIG. 5, a ±1 millivolt change in $V_{DIODE}$ can be maintained for temperatures ranging from 0–100 degrees Celsius with $V_{DD}$ ranging from 1.8 to 3.6 volts.

Figure 6:
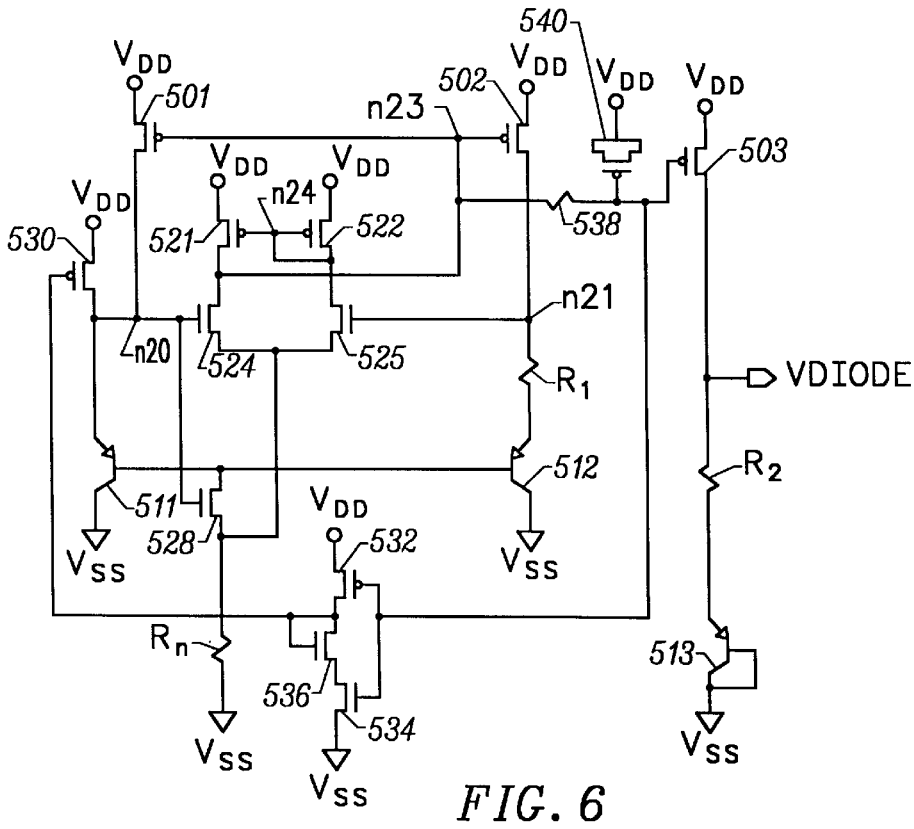
FIG. 6 shows modifications to the opamp in the circuit of FIG. 5 to reduce component count.

FIG. 6 shows modifications to the opamp circuitry in FIG. 5 to reduce component count. In particular, in FIG. 6 the transistors 523 and 526 are eliminated from the opamp circuitry of FIG. 5. Transistors 523 and 526 function to buffer node n22 from the opamp output at node n23 and to increase gain. Note that components carried over from FIG. 5 to FIG. 6 as well as subsequent drawings are similarly labeled.

In addition to elimination of transistors 523 and 526, in the circuit of FIG. 6, the gate of transistors 521 and 522 are disconnected from the drain of transistor 521 and connected to the drain of transistor 522. The drain of transistor 521 is further connected to node n23 to form the opamp output.

Figure 7:
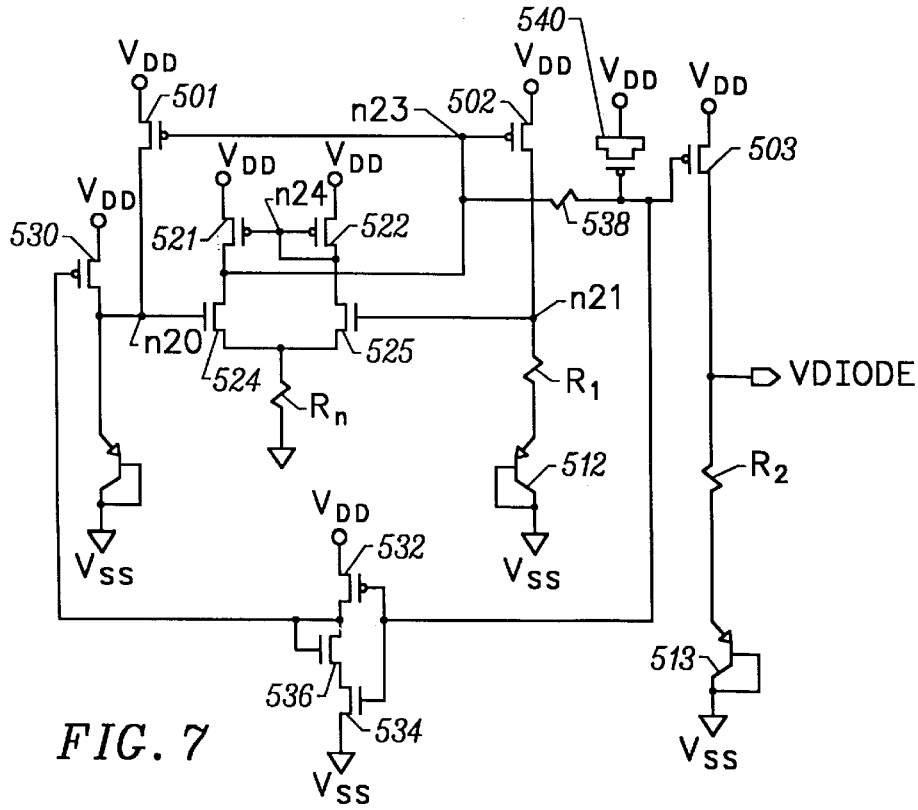
FIG. 7 shows further modifications to the circuit of FIG. 5 to reduce component count.

FIG. 7 shows further modifications to the circuit of FIG. 5 to reduce component count. In particular in FIG. 5, the transistor 528 of FIG. 5 is removed. Further, the PNP transistors 511 and 512 are connected in a diode configuration with a base and collector connected to $V_{SS}$. As indicated above, without biasing the base of transistors 511 and 512 using transistor 528 and resistor Rn, a slight variation in the current output from current sources 501–503 can occur.

Although the present invention has been described above with particularity, this was merely to teach one of ordinary skill in the art how to make and use the invention. Many additional modifications will fall within the scope of the invention, as that scope is defined by the claims which follow.

What is claimed is:

1. A band gap reference comprising:

an operational amplifier (opamp) having a (+) input, a (−) input, and an output;

a first diode having a first terminal coupled to $V_{SS}$, and a second terminal coupled to the (+) input of the opamp;

a first current source transistor having a source to drain path coupling $V_{DD}$ to the second terminal of the first diode, and a gate coupled to the output of the opamp;

a second diode having a first terminal coupled to $V_{SS}$, and a second terminal;

a first resistor having a first terminal coupled to the second terminal of the second diode, and a second terminal coupled to the (−) input of the opamp;

a second current source transistor having a source to drain path coupling $V_{DD}$ to the second terminal of the first resistor, and a gate coupled to the output of the opamp;

a third diode having a first terminal coupled to $V_{SS}$, and a second terminal;

a second resistor having a first terminal coupled to the second terminal of the third diode, and a second terminal providing the output of the band gap reference; and a third current source transistor having a source to drain path coupling $V_{DD}$ to the second terminal of the second resistor, and a gate coupled to the output of the opamp.

2. The band gap reference of claim 1, wherein the first, second and third diodes comprises a PNP transistor having a base and collector coupled to form their second terminal and an emitter forming their first terminal.

3. The band gap reference of claim 1, wherein the first, second and third current source transistors are PMOS devices.

4. The band gap reference of claim 1 wherein the opamp comprises:

a first transistor (524) having a gate forming the (+) input of the opamp, and a source to drain path with a first end coupled to $V_{SS}$;

a second transistor (525) having a gate forming the (−) input of the opamp, and a source to drain path with a first end coupled to the first end of the source to drain path of the first transistor (524);

a third transistor (521) having a source to drain path coupling $V_{DD}$ to a second end of the source to drain path of the first transistor (524), and having a gate forming the output of the opamp; and a fourth transistor (522) having a source to drain path coupling $V_{DD}$ to a second end of the source to drain path of the second transistor (525), and having a gate coupled to the gate of the third transistor (521) and to the second end of the source to drain path of the second transistor (525).

5. The band gap reference of claim 1 wherein the opamp comprises:

a first transistor (524) having a gate forming the (+) input of the opamp, and a source to drain path with a first end coupled to $V_{SS}$;

a second transistor (525) having a gate forming the (−) input of the opamp, and a source to drain path with a first end coupled to the first end of the source to drain path of the first transistor (524);

a third transistor (521) having a source to drain path coupling $V_{DD}$ to a second end of the source to drain path of the first transistor (524), and having a gate coupled to the second end of the source to drain path of the first transistor (524);

a fourth transistor (522) having a source to drain path coupling $V_{DD}$ to a second end of the source to drain path of the second transistor (525), and having a gate coupled to the gate of the third transistor (521);

a fifth transistor (523) having a gate coupled to the second end of the source to drain path of the second transistor (525), and a source to drain path coupling $V_{DD}$ to the output of the opamp; and a sixth transistor (526) having a gate coupled to the gate of the first transistor (524), and a source to drain path coupling the output of the opamp to $V_{DD}$.

6. The band gap reference of claim 1 further comprising:

a first PMOS transistor (530) having a source to drain path coupling $V_{DD}$ to the (+) input of the opamp, and having a gate;

a second PMOS transistor (532) having a source to drain path coupling $V_{DD}$ to the gate of the first PMOS transistor (530), and having a gate coupled to the output of the opamp;

a first NMOS transistor (534) having a gate coupled to the output of the opamp, and having a source to drain path coupled on a first end to $V_{SS}$;

a second NMOS transistor (536) having a gate coupled to the gate of the first PMOS transistor (530), and a source to drain path coupling a second end of the source to drain path of the first NMOS transistor (534) to the gate of the first PMOS transistor (530).

7. A band gap reference comprising:

an operational amplifier (opamp) having a (+) input, a (−) input, and an output, the opamp comprising:

a first transistor (524) having a gate forming the (+) input of the opamp;

a second transistor (525) having a gate forming the (−) input of the opamp, and a source to drain path connected on a first end to a first end of the source to drain path of the first transistor (524); and a current mirror comprising:

a third transistor (521) having a source to drain path coupling $V_{DD}$ to a second end of the source to drain path of the first transistor (524), and having a gate; and a fourth transistor (522) having a source to drain path coupling $V_{DD}$ to a second end of the source to drain path of the second transistor (525), and having a gate coupled to the gate of the third transistor (521);

a current sink having a first terminal coupled to $V_{SS}$, and a second terminal coupled to the first end of the source to drain path of the first transistor (524) and the second transistor (525);

a first bipolar transistor (511) having an emitter to collector path coupling the (+) input of the opamp to $V_{SS}$, and a base coupled to the second terminal of the current sink;

a first current source transistor (501) having a source to drain path coupling $V_{DD}$ to the (+) input of the opamp, and having a gate coupled to the output of the opamp;

a first resistor ($R_1$) having a first terminal coupled to the (−) input of the opamp, and a second terminal;

a second bipolar transistor (512) having an emitter to collector path coupling the second terminal of the first resistor ($R_1$) to $V_{SS}$, and a base coupled to the base of the first bipolar transistor (511);

a second current source transistor (502) having a source to drain path coupling $V_{DD}$ to the (−) input of the opamp, and having a gate coupled to the output of the opamp;

a second resistor ($R_2$) having a first terminal forming the output of the band gap reference, and a second terminal;

a third bipolar transistor (513) having an emitter to collector path coupling the second terminal of the second resistor ($R_2$) to $V_{SS}$, and having a base coupled to $V_{SS}$; and a third current source transistor (503) having a source to drain path coupling $V_{DD}$ to the output of the band gap reference, and having a gate coupled to the output of the opamp.

8. The band gap reference of claim 7, wherein the current sink comprises a third resistor (Rn).

9. The band gap reference of claim 7 further comprising:

a fifth transistor (528) having a source to drain path coupling the gates of the first bipolar transistor (511) and second bipolar transistor (512) to the second terminal of the current sink, and having a gate coupled to the (+) input of the opamp.

10. The band gap reference of claim 9, wherein the gate of the fourth transistor (522) is coupled to the second end of the source to drain path of the second transistor (525) to form the output of the opamp.

11. The band gap reference of claim 10 further comprising:

a fifth transistor (528) having a source to drain path coupling the gates of the first bipolar transistor (511) and second bipolar transistor (512) to the second terminal of the current sink, and having a gate coupled to the (+) input of the opamp.

12. The band gap reference of claim 9, wherein the gate of the third transistor (521) is coupled to the second end of the source to drain path of the first transistor (524), the band gap reference further comprising:

a fifth transistor (523) having a gate coupled to the second end of the source to drain path of the second transistor (525), and a source to drain path coupling $V_{DD}$ to the output of the opamp; and a sixth transistor (526) having a gate coupled to the gate of the first transistor (524), and a source to drain path coupling the output of the opamp to the second end of the current sink.

13. The band gap reference of claim 7 further comprising:

a first PMOS transistor (530) having a source to drain path coupling $V_{DD}$ to the (+) input of the opamp, and having a gate;

a second PMOS transistor (532) having a source to drain path coupling $V_{DD}$ to the gate of the first PMOS transistor (530), and having a gate coupled to the output of the opamp;

a first NMOS transistor (534) having a gate coupled to the output of the opamp, and having a source to drain path coupled on a first end to $V_{SS}$;

a second NMOS transistor (536) having a gate coupled to the gate of the first PMOS transistor (530), and a source to drain path coupling a second end of the source to drain path of the first NMOS transistor (534) to the gate of the first PMOS transistor (530).

14. A band gap reference comprising:

an operational amplifier (opamp) having a (+) input, a (−) input, and an output, the opamp comprising:

a first transistor (524) having a gate forming the (+) input of the opamp;

a second transistor (525) having a gate forming the (−) input of the opamp, and a source to drain path connected on a first end to a first end of the source to drain path of the first transistor (524); and a current mirror comprising:

a third transistor (521) having a source to drain path coupling $V_{DD}$ to a second end of the source to drain path of the first transistor (524), and having a gate; and a fourth transistor (522) having a source to drain path coupling $V_{DD}$ to a second end of the source to drain path of the second transistor (525), and having a gate coupled to the gate of the third transistor (521);

a first resistor (Rn) having a first terminal coupled to $V_{SS}$ and a second terminal coupled to the first end of the source to drain path of the first transistor (524);

a fifth transistor (528) having a source to drain path with a first end coupled to the second terminal of the first resistor (Rn), a second terminal, and having a gate coupled to the (+) input of the opamp;

a first bipolar transistor (511) having an emitter to collector path coupling the (+) input of the opamp to $V_{SS}$, and a base coupled to the second end of the source to drain path of the fifth transistor (528);

a first current source transistor (501) having a source to drain path coupling $V_{DD}$ to the (+) input of the opamp, and having a gate coupled to the output of the opamp;

a second resistor ($R_1$) having a first terminal coupled to the (−) input of the opamp, and a second terminal;

a second bipolar transistor (512) having an emitter to collector path coupling the second terminal of the second resistor ($R_1$) to $V_{SS}$, and a base coupled to the base of the first bipolar transistor (511);

a second current source transistor (502) having a source to drain path coupling $V_{DD}$ to the (−) input of the opamp, and having a gate coupled to the output of the opamp;

a third resistor ($R_2$) having a first terminal forming the output of the band gap reference, and a second terminal;

a third bipolar transistor (513) having an emitter to collector path coupling the second terminal of the third resistor ($R_2$) to $V_{SS}$, and having a base coupled to $V_{SS}$; and a third current source transistor (503) having a source to drain path coupling $V_{DD}$ to the output of the band gap reference, and having a gate coupled to the output of the opamp.

15. The band gap reference of claim 14, wherein the gate of the third transistor (521) is coupled to the second end of the source to drain path of the first transistor (524), the band gap reference further comprising:

a fifth transistor (523) having a gate coupled to the second end of the source to drain path of the second transistor (525), and a source to drain path coupling $V_{DD}$ to the output of the opamp; and a sixth transistor (526) having a gate coupled to the gate of the first transistor (524), and a source to drain path coupling the output of the opamp to the second terminal of the first resistor (Rn).

16. The band gap reference of claim 15 further comprising:

a first PMOS transistor (530) having a source to drain path coupling $V_{DD}$ to the (+) input of the opamp, and having a gate;

a second PMOS transistor (532) having a source to drain path coupling $V_{DD}$ to the gate of the first PMOS transistor (530), and having a gate coupled to the output of the opamp;

a first NMOS transistor (534) having a gate coupled to the output of the opamp, and having a source to drain path coupled on a first end to $V_{SS}$;

a second NMOS transistor (536) having a gate coupled to the gate of the first PMOS transistor (530), and a source to drain path coupling a second end of the source to drain path of the first NMOS transistor (534) to the gate of the first PMOS transistor (530).

17. The band gap reference of claim 16, wherein the first transistor (524), the second transistor (525), and the sixth transistor (523) are NMOS transistors, and wherein the third transistor (521), the fourth transistor (522), the fifth transistor (528), the first current source transistor (501), the second current source transistor (502), the third current source transistor (502), and the sixth transistor (526) are PMOS transistors.

* * * * *